US005269214A

United States Patent [19]

Badura et al.

[11] Patent Number: 5,269,214

[45] Date of Patent: Dec. 14, 1993

[54] PROJECTOR ASSEMBLY FOR A DEFENSIVE PROJECTING DEVICE

[75] Inventors: Wolfgang Badura, Bad Reichenhall; Harald Watzinger, Inzell; Kurt Adamek, Bischofswiesen, all of Fed. Rep. of Germany

[73] Assignee: Buck Werke GmbH & Co., Uberkingen, Fed. Rep. of Germany

[21] Appl. No.: 921,733

[22] Filed: Jul. 30, 1992

[30] Foreign Application Priority Data

Jul. 31, 1991 [DE] Fed. Rep. of Germany ..... 4125356

[51] Int. Cl.[5] ..... F41F 1/08

[52] U.S. Cl. ..... 89/1.41; 42/105; 89/1.816

[58] Field of Search ..... 42/105; 89/1.41, 1.34, 89/1.816, 1.818, 126

[56] References Cited

U.S. PATENT DOCUMENTS

| | | | |
|---|---|---|---|
| 3,421,242 | 1/1969 | Lizza | 42/105 |
| 3,643,545 | 2/1972 | Nahas | 42/105 |
| 3,708,563 | 1/1973 | Sells | 89/1.816 |
| 3,712,224 | 1/1973 | Hanzel | 42/105 |
| 3,808,940 | 5/1974 | Schillreff et al. | 89/1.41 |
| 4,012,985 | 3/1977 | Magnusson | 89/1.818 |
| 4,063,485 | 12/1977 | Carter et al. | 89/1.816 |
| 4,222,306 | 9/1980 | Maury | 89/1.41 |
| 4,305,325 | 12/1981 | Lange et al. | 89/1.816 |
| 4,470,336 | 9/1984 | Swann et al. | 89/1.816 |

*Primary Examiner*—David H. Brown

*Attorney, Agent, or Firm*—Watson, Cole, Grindle & Watson

[57] ABSTRACT

A projector assembly of a defensive projecting device for containing a plurality of projectiles for defending a given object, the assembly including a plurality of projectors combined into a unitary magazine block which can be slid into a magazine carrier having a bottom plate and a magazine shoe, and locked in place. The magazine carrier is mounted on the object to be defended.

5 Claims, 6 Drawing Sheets

PROJECTOR ASSEMBLY FOR A DEFENSIVE PROJECTING DEVICE

BACKGROUND OF THE INVENTION

This invention relates to a defensive projecting device as used, for example, to defend tanks. The projecting device comprises a plurality of projectors which are suitably mounted on the exterior of the tank. The projectors are used to launch projectiles which each include a propellant charge and an active charge wherein the latter is usually a smoke charge. The projectiles are ignited electrically from inside the tank where ignition contacts which make contact with contact rings located on the projectile shelf, are disposed in the projector. Also known are ignition systems that have no contacts, namely, inductive ignition systems. The electric energy received via contacts, or without contacts is used in the projectile to ignite the propellant charge such that the hot propellant gases ignite the active charge via a pyrotechnical igniter train with a delay element.

Typically the projector is mounted on its foundation, such as the exterior of a tank, in the shop by the mechanic since the electric lines of the ignition system must also be correspondingly attached. When one or more projectors are fired the fired projectile(s) must be replaced thereby involving a significant amount of time. If projectiles of different active charge are fired from different projectors, reloading must be carried out with the proper ammunition which can easily lead to mixups and confusion.

SUMMARY OF THE INVENTION

It is therefore an object of the present invention to provide a projector assembly of a defensive projecting device in such a manner that a simple, fast and, even when using different projector ammunition, improved reloading is possible.

The assembly contains a plurality of projectiles for defending a given object and includes a magazine block of unitary structure, the block having a plurality of through openings defining a plurality of projectors. A magazine carrier is attached to the object to be presented, and the magazine block is slid into engagement with a forked recess formed in the carrier for locking the magazine block thereto. Rather than, as before, providing individual projectors, a magazine carrier is provided into which the projector magazine can be inserted and thus attached to the object to be defended. After a projectile is fired, a stop located on the magazine carrier is released, the magazine is removed from the carrier, and a new magazine loaded with projectiles is reengaged with the carrier. This process can be quickly carried out with efficiency in a battle situation.

Also, a cover block may be provided that fits into the magazine carrier and can be slid into engagement therewith similarly as the magazine block. The cover block may have electronic circuits which similate projectile discharges for training purposes.

BRIEF DESCRIPTION THE DRAWINGS

Figure 1:
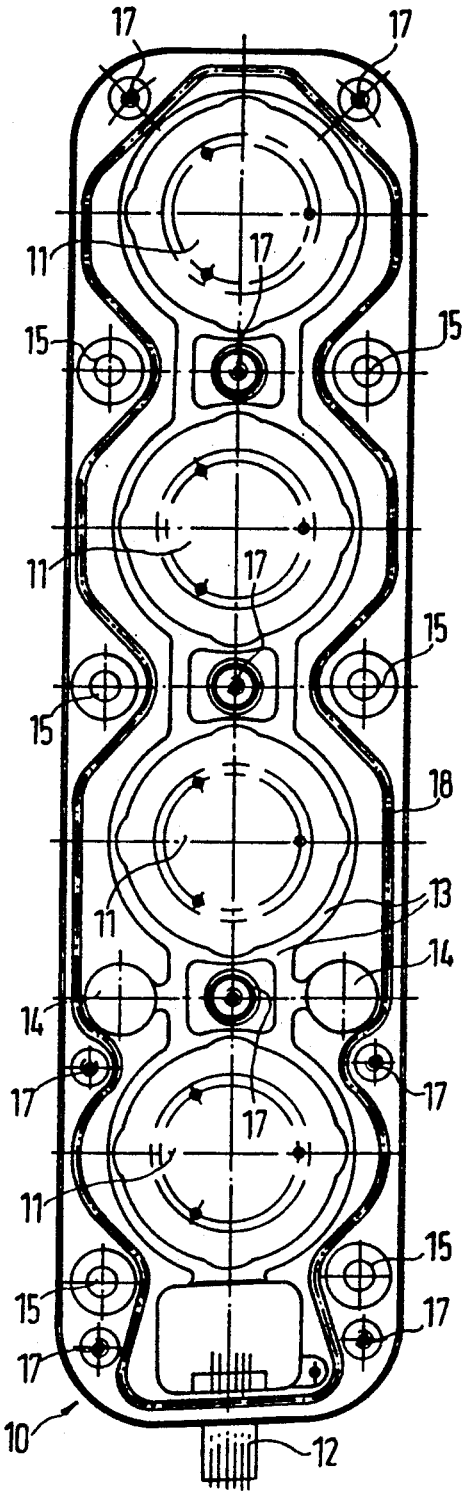
FIG. 1 is top plan view of a bottom plate of a part of the magazine carrier according to the invention.
Figure 2:
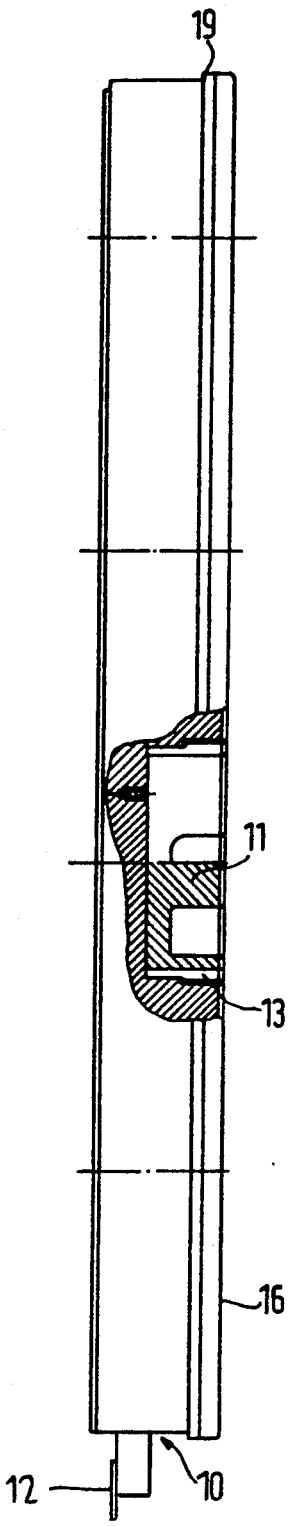
FIG. 2 is a side elevational view, partly in section, of the bottom plate of FIG. 1.
Figure 3:
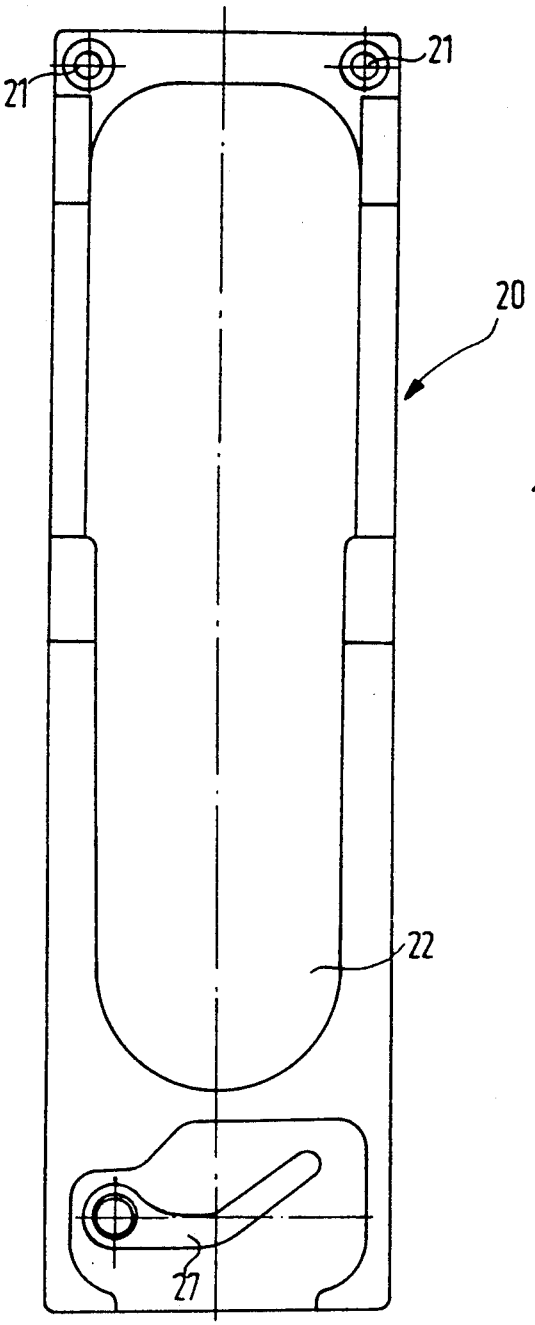
FIG. 3 is a top plan view of a magazine carrier or shoe forming a part of the projector assembly of the invention.
Figure 4:
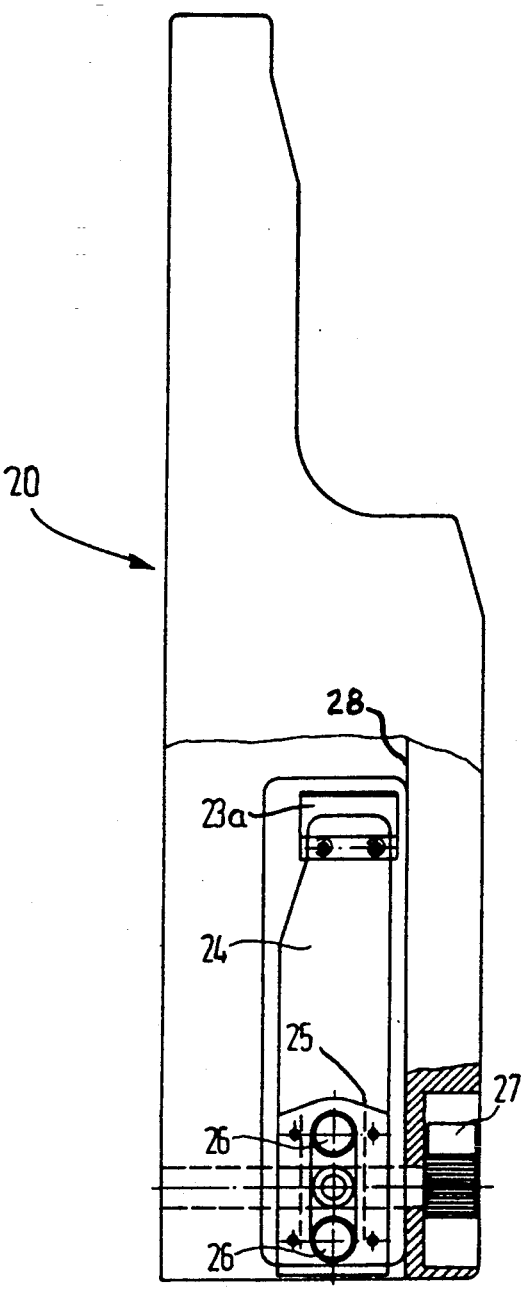
Figure 3A:
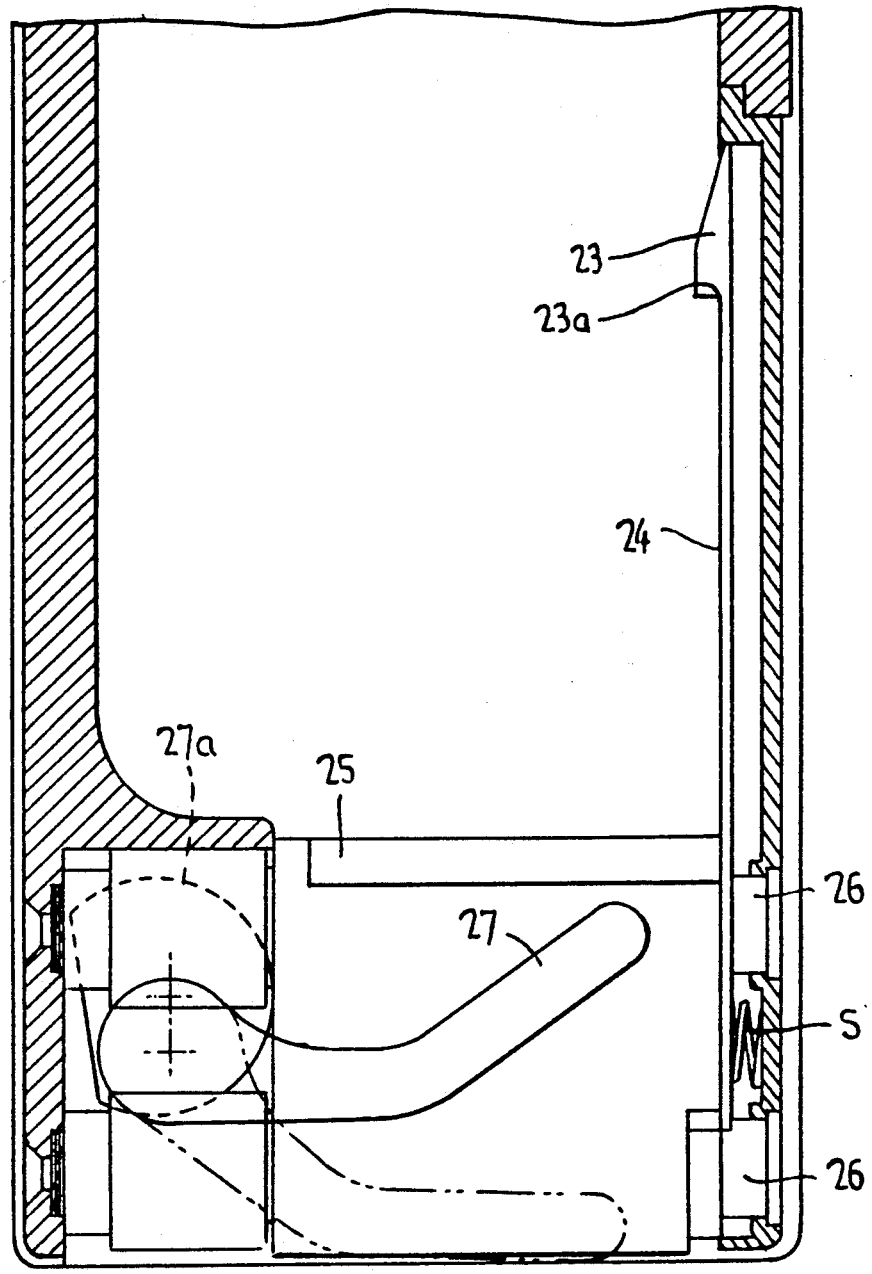
Figure 6:
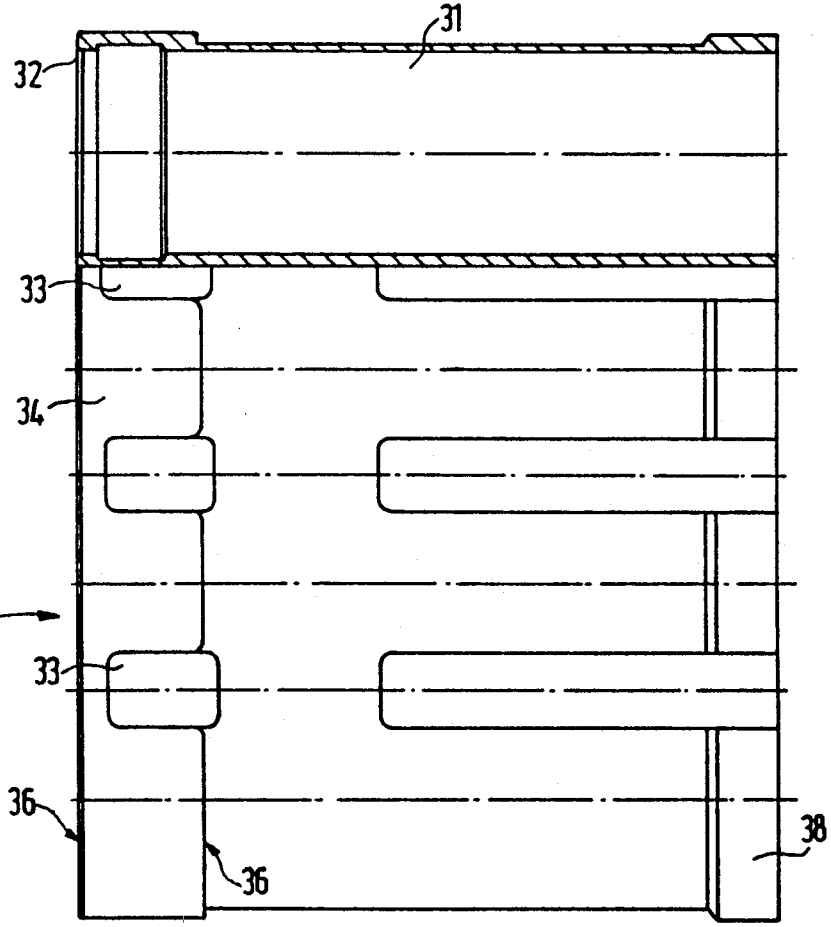
Figure 5:
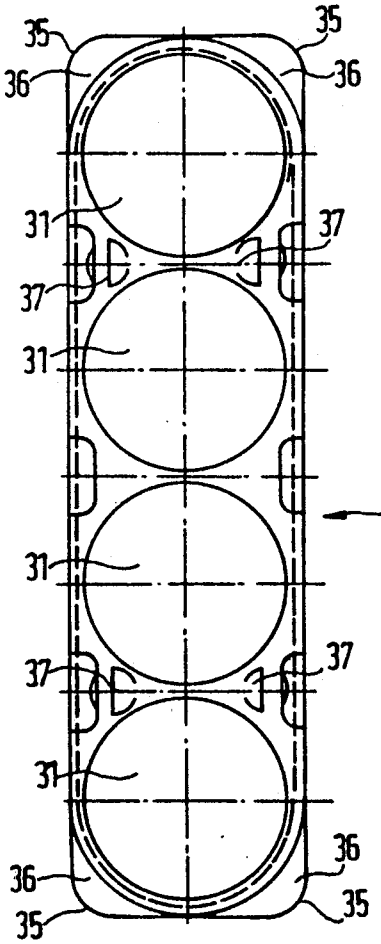
Figure 7:
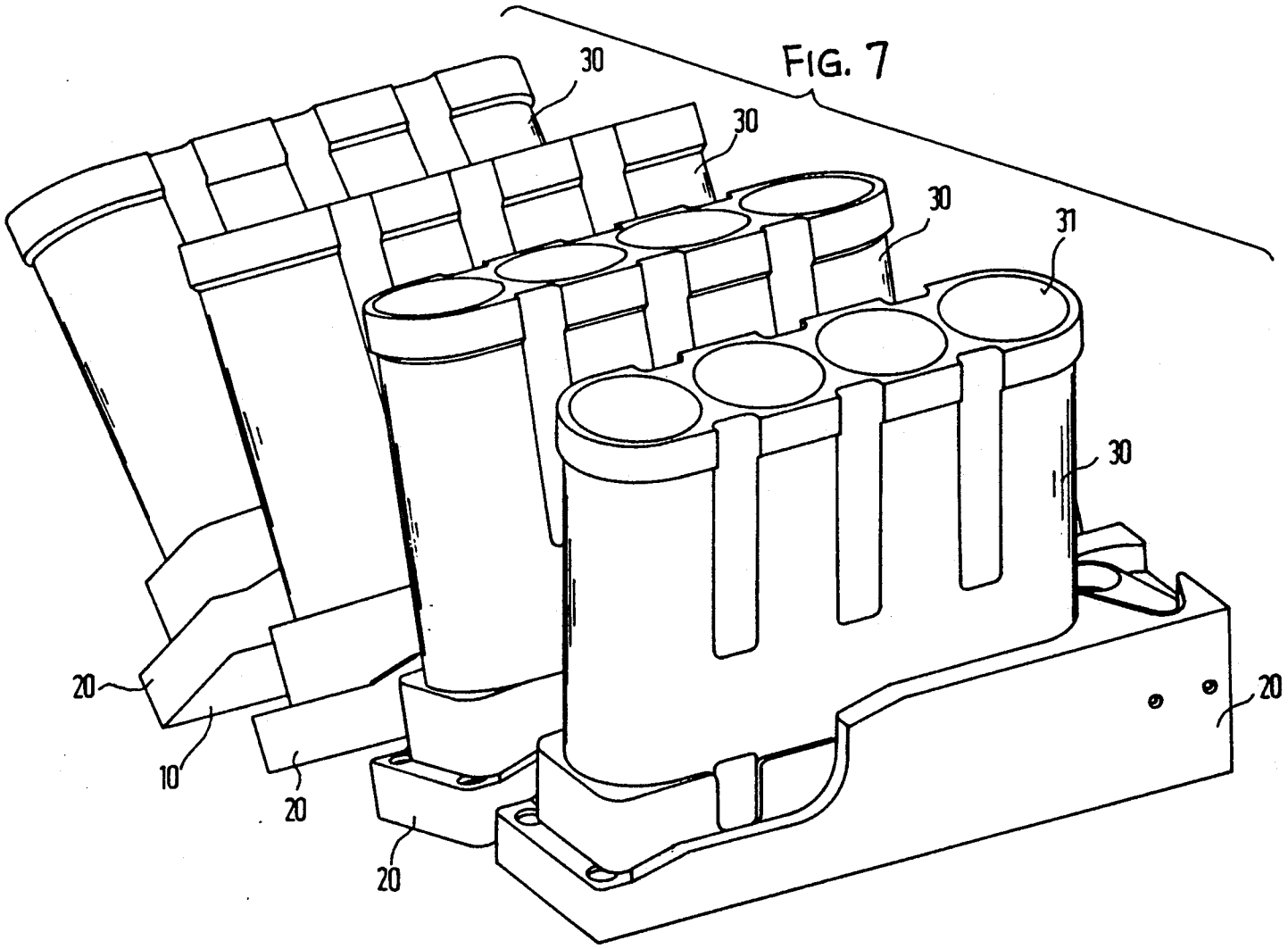
Figure 8:
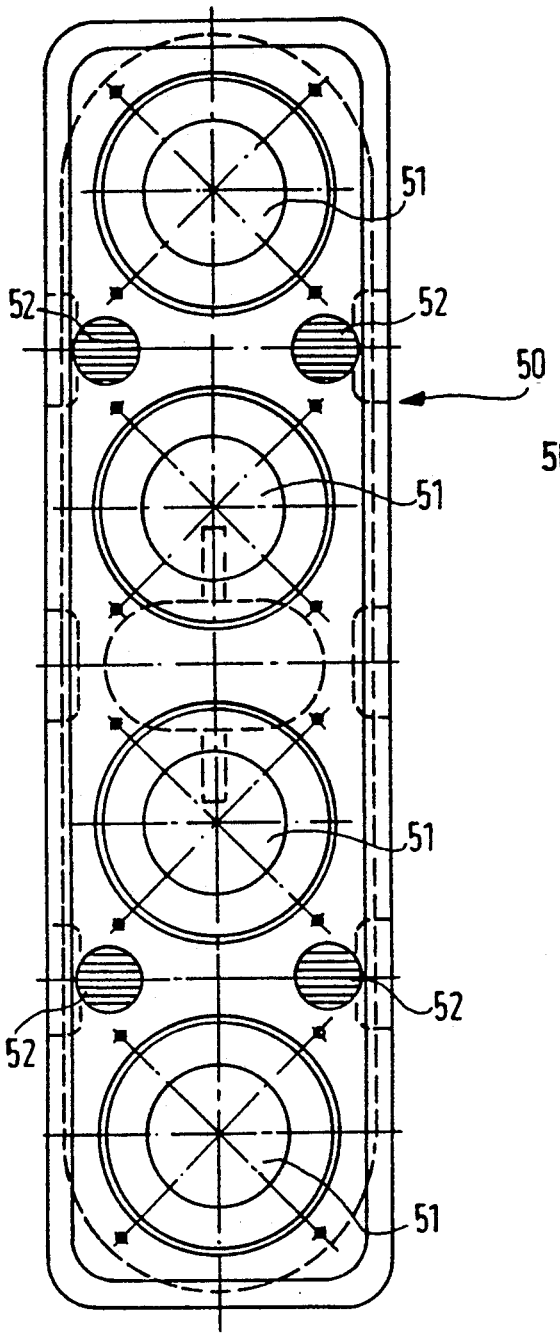
Figure 9:
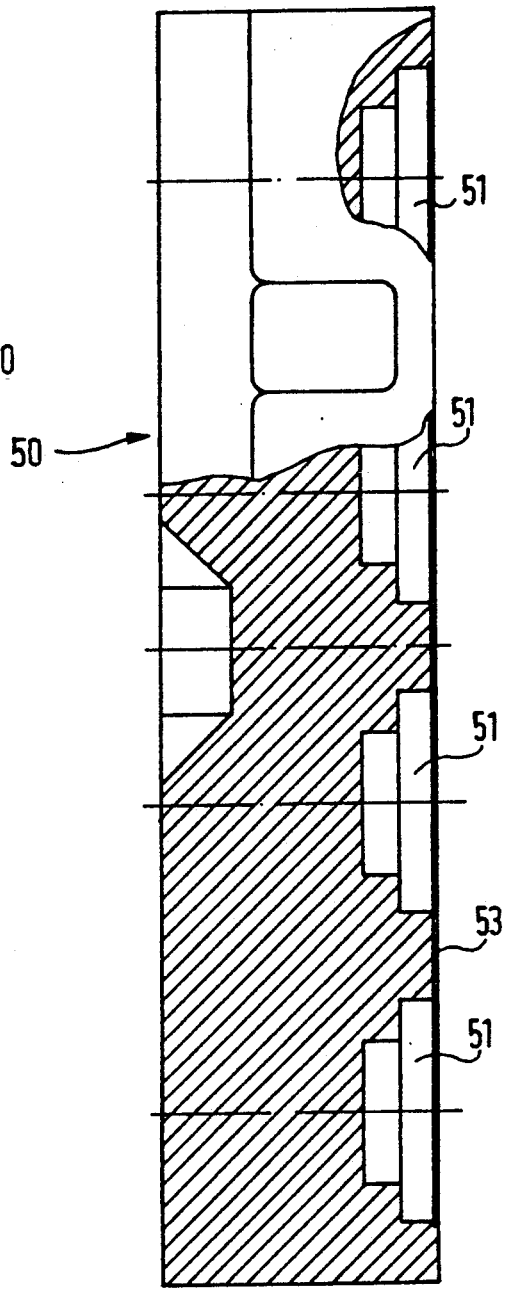

FIG. 3*a* is a view similar to FIG. 3, partly in section, showing details of the lock mechanism for the magazine block;

FIG. 4 is a side elevational view, partly in section, of the magazine carrier of FIG. 3;

FIG. 5 is a top plan view of a magazine block forming part of the projector assembly of the invention;

FIG. 6 is a side elevational view, partly in section, of the FIG. 5 magazine block;

FIG. 7 is a perspective view of four magazine carriers assembled together with magazine blocks according to the invention;

FIG. 8 is a top plan view of a cover block used as an alternative component of the projector assembly of the invention; and FIG. 9 is a side elevational view, partly in section, of the cover block of FIG. 8.

DETAILED DESCRIPTION OF THE INVENTION

The magazine carrier has a bottom plate 10 which functions as a foundation in which the firing recoil forces are introduced and are transferred to the firing platform of the object to be defended (not shown). In addition, bottom plate 10 serves to transfer electric energy and comprises for this purpose the primary side of an inductive ignition system. The energy transfer members comprise primary transformer cores 11 with related wire windings. The connection of the wire windings to the power supply, such as a cable plug 12, is effected via a cable harness embedded in cable channels 13. Sensor cores 14 provided with wire spools serve to sense the presence of the magazine block and ammunition.

Bottom plate 10 is attached as at 15 to the firing platform of the object to be defended, such as a tank. A stainless steel cover lid 16 locks the entire energy transfer portion into the bottom plate. Cover 16 is attached and sealed to the bottom plate via screws 17 and a sealing strip 18. The outer contour of the bottom plate has a fitting rim 19 by means of which a magazine shoe or carrier 20 is centered and its load is distributed.

This magazine shoe or carrier 20 shown in FIGS. 3 and 4 has screws 21 for attachment, is centered via bottom plate 10 and is braced via the bottom plate on the firing platform. The magazine shoe has a forked recess 22 defining a lip 28 for the sliding support of the magazine block to be described in more detail hereinafter. The forked recess provides a guideway for magazine block 30, and the block is positively held in place via a lock mechanism comprising elements 23, 24, 25 and 26. A lever 27 having a cam 27*a* serves to unlock the lock mechanism. The entire lock mechanism including the unlocking lever is housed within the shell contour of magazine carrier 20 and is protected by a cover (not shown) from dirt and mechanical destruction.

As shown in more detail in FIG. 3*a*, when lever 27 is rotated to its phantom outline position, its cam 27*a* shifts block 25 (to the right in the drawing) against the bias of spring S. Spring tongue 24, having a hooked end 23, is mounted on block 25 and is guided during shifting movement along guide pins 26. Thus, when shifted upon operation of lever 27, end 23 shifts outwardly of recess 23*a* for thereby unlocking the magazine block.

As shown in FIGS. 5 and 6, magazine block 30 is insertable in the magazine carrier and has four projectors 31 which are arranged side-by-side and integrally formed with the block for launching of the projectiles (not illustrated). Deformable locking elements 32 are provided for receiving and arresting the projectiles. Recesses 33 in base 34 of the magazine block form block points for engagement with the aforedescribed lock mechanism of the magazine carrier.

Magazine base 34 can be moved so as to automatically center itself by its corner radii 35 and surfaces 36 forming support shoulders which underlie lip 28 at the inner end of the forked recess 22 of the carrier. Sensor plates 37 in magazine base 34 sense the ammunition in interaction with sensors 15 of bottom plate 10. Because of the symmetry of magazine base 34 magazine 30 does not have a preferred loading direction on the object to be defended. Thus, the magazine block can be inserted into the magazine carrier from either end of the block.

A circular rim 38 on the aperture side of the magazine block forms an absorber for the aperture pressure generated by firing the ammunition and additionally serves in general as an energy absorber on the front side of the block, for example, during a drop test.

FIG. 7 is a perspective view of an arrangement with four magazine carriers 20 with a magazine block 30 inserted in each carrier. Such a defensive system with four magazine blocks is suitable, for example, for attachment to one side of a vehicle, such as a tank. The firing platforms for the magazine carrier attachment are at an elevation and azimuth angle corresponding to the operational requirement for the defensive measure. Following mounting of the magazine carriers on the firing platform, the magazine blocks are inserted into each carrier. Preferably, the magazine blocks are of elastomeric material which assures an elasticity in the temperature range of −40° C. and +70° C. Because of the aforementioned stops, the elastomeric material of the magazine blocks allows the ammunition to be slid into the projectors with a minimum force and to hold them therein with high clamping force so as to be vibration-proof and drop-proof. Moreover the elastomeric magazine block has the advantage that given a suitable weight, it automatically snaps into the locking device of carrier 20 without requiring any special manipulation of a bolt or the like.

It should be pointed out that the firing of the ammunition from a magazine of elastomeric material is accelerated at its own housing sleeve which remains in the projector. The firing can be carried out individually or magazine-wise whereby the aforementioned sensors report where a projectile must be reloaded and thus which magazine must be replaced. In so doing the reloading is effected simply and quickly such as merely by depressing lever 27 such that the magazine block is unlocked, removed from the magazine carrier and a new magazine block (loaded with projectiles) inserted.

Metal plates on the surface of the magazine blocks serve to render detectable the loading condition of the sensors of bottom plate 10.

The magazines can be loaded with projectiles of any active compositions, provided that the projectiles have an inductive ignition system, that is secondary transformer cores interacting with primary transformer cores. Especially suitable are smoke projectors disclosed in U.S. patent application Ser. No. 907,043, pending (in issue) filed on Jul. 1, 1992, and commonly owned herewith.

FIGS. 8 and 9 show a cover plate 50 the outer dimensions and outer contour of which correspond to the basic section of magazine carrier 30. The outer contour has recesses for the engagement of the lock mechanism of the magazine shoe. The material of cover plate 50 may be of rubber, plastic or light-weight metal. In accordance with the number of primary transformer cores of bottom plate 10, secondary replacement circuits 51 (simulator) are housed in cover plate 50. For sensing the cover plate metal disks 52 are provided in its surface, and the contact side of the cover plate is covered by a high grade steel plate 53.

The cover plate is intended to be inserted, in place of a magazine block, into magazine carrier 20. The cover plate offers mechanical protection for the guide section of the magazine shoe and covers bottom plate 10 with its inductive transformer cores and center cores, thus protecting them against dirt, water and mechanical distruction. Moreover, the simulator of cover plate 50 serves for training purposes, i.e., the actual firing of the projectiles from the magazine blocks 30 can be simulated, a feature that is very advantageous for training tank gunners.

What is claimed is:

1. A projector assembly of a defensive projecting device for containing a plurality of projectiles for defending a given object, comprising a magazine block having a unitary structure, the block having a base and an opposing end, the base defining opposing support shoulders, and the block having a plurality of elongated, adjacent, through openings extending between the base and the opposing end and defining a plurality of projectors, and a magazine carrier having a bottom plate defining a base attached to the object to be defended, the carrier having a magazine shoe integral with the bottom plate and forming an open, forked recess defining a guideway for sliding engagement with the support shoulders for coupling the magazine block to the magazine carrier the bottom plate containing a primary side of an inductive ignition system for the transfer of energy for the firing of projectiles, and the carrier having a lock mechanism including a lock element in engagement with the magazine block for locking the block to the carrier.

2. The projector assembly according to claim 1, wherein the bottom plate has sensor cores with wire spools for sensing the magazine block when engaged with the carrier.

3. The projector assembly according to claim 1, wherein the magazine block is of elastomeric material.

4. The projector assembly according to claim 1, further comprising a cover block having a base defining support shoulders for alternative sliding engagement with the lip of the carrier in a non-use condition of the magazine block.

5. The projector assembly according to claim 4, wherein the cover block includes electronic simulator circuits coupled to the ignition system for simulating the firing of a projectile.

* * * * *